United States Patent [19]

Golub

[11] Patent Number: 4,554,420

[45] Date of Patent: Nov. 19, 1985

[54] ELECTRICAL SWITCH

[75] Inventor: Gregory J. Golub, Athens, Ga.

[73] Assignee: Westinghouse Electric Corp., Pittsburgh, Pa.

[21] Appl. No.: 606,072

[22] Filed: May 1, 1984

[51] Int. Cl.[4] ..... H01H 9/30; H01H 21/50

[52] U.S. Cl. ..... 200/11 TC; 200/11 B; 200/151

[58] Field of Search ..... 200/11 B, 11 TC, 11 K, 200/17 R, 18, 70, 153 SC, 307, 318, 321, 151

[56] References Cited

U.S. PATENT DOCUMENTS

| | | | |
|---|---|---|---|
| 2,009,383 | 7/1935 | Blume | 200/11 TC |
| 2,177,109 | 10/1939 | Hill | 200/11 TC |
| 3,150,243 | 9/1964 | Hermann | 200/63 R |
| 3,330,919 | 7/1967 | Kovats | 200/153 SC |
| 3,461,259 | 8/1969 | Leonard et al. | 200/63 A |
| 3,462,611 | 8/1969 | McMorris | 307/17 |
| 3,590,183 | 6/1971 | Leonard | 200/67 B |
| 3,715,543 | 2/1973 | Keto et al. | 200/155 R X |
| 3,919,512 | 11/1975 | Ray et al. | 200/153 SC |
| 4,412,116 | 10/1983 | Golub | 200/11 TC X |
| 4,446,343 | 5/1984 | Golub et al. | 200/11 TC |

*Primary Examiner*—J. R. Scott

*Attorney, Agent, or Firm*—D. R. Lackey

[57] ABSTRACT

A rotary, snap-action electrical switch suitable for immersion in the liquid dielectric of an electrical transformer. The switch includes a multi-position operating mechanism which latches each switch position while preventing contact rebound, absorbing all closing forces in the mechanism itself. A switch position indicator follows the movable contact, and not the actuating handle. A three-position embodiment of the switch rotates one end of a pivotable contact on a stationary contact, removing contact bias means from the current path. The remaining end is selectively engageable with either of two additional stationary contacts, as well as having a non-contact open circuit position. The pivotable contact is driven at a point intermediate its ends, to increase the torque arm and thus obtain the desired operating force with substantially reduced forces between the driving member and the contact carrier.

21 Claims, 10 Drawing Figures

ELECTRICAL SWITCH

BACKGROUND OF THE INVENTION

1. Field of the Invention:

The invention relates in general to electrical switches, and more specifically, to load-break, under-oil type switches suitable for immersion in the liquid dielectric of a distribution transformer.

2. Description of the Prior Art:

U.S. Pat. Nos. 3,461,259 and 3,590,183, which are assigned to the same assignee as the present application, disclose load-break switches suitable for use in loop type primary distribution systems. Two such switches are disposed in each distribution transformer of the loop, with the switches being immersed in the liquid dielectric of the transformer. The primary winding of each transformer is selectively connectable to either or both sides of the distribution loop by the two switches. The quick-make, quick-break action of the switch enables the switch to be closed on a fault, as well as to be opened while the transformer is carrying load current.

While switches constructed according to the teachings of these patents have performed very well, I have made certain improvements to the basic switch construction related to contact alignment, and the ability to increase contact pressure during momentary high current surges. These improvements are disclosed in detail in my U.S. Pat. No. 4,412,116, issued Oct. 25, 1983, which is assigned to the same assignee as the present application.

I have also observed that with the over-center type operating mechanism utilized by the switch of the hereinbefore-mentioned patents, a spring holds the switch open, and the spring also holds the switch closed. With the quick make-quick break action essential in order for the switch to pass load interruption and fault close-in tests, large mechanical forces must be absorbed on close-in, resulting in some contact rebound due to the characteristics of the spring. Also, with an over-center operating mechanism, it is possible to operate the mechanism to an intermediate balance point, i.e., precisely on center, without causing movement of the movable contacts. Thus, the position of the operating handle and the associated switch position indicator would indicate that the switch is in a different position than it actually is. Finally, the over-center operating mechanism of the switch disclosed in the hereinbefore-mentioned patents is only suitable for use with a two-position switch. Some applications for switching the primary of a distribution transformer in a loop feed require an additional switch position for grounding the distribution cable. Thus, it would be desirable to provide a new and improved quick-make, quickbreak switch having an operating mechanism which may be used with at least two and three position switches. It would also be desirable for such an operating mechanism to operate with the requisite snap action, without contact rebound. Finally, it would be desirable for the contact position indicator to always correctly indicate the actual switch position.

SUMMARY OF THE INVENTION

Briefly, the present invention is a new and improved load-break, under-oil rotary switch. The switch includes a switch frame having stationary contacts, a multi-position operating mechanism, a switch rotor having movable contacts, and means interconnecting the operating mechanism and the switch rotor. The number of switch operating positions, and their orientation about the axis of rotor rotation is selectable by the number and position of stop members fixed to the switch frame. The operating mechanism includes first and second relatively rotatable nested portions interrelated by torsion springs, with the first nested portion being linked to the rotor and its movable contacts, and with the second nested portion including an actuating shaft. The first nested portion also includes first and second latch members, with one latch member engaging a stop member to stop the rotation of the first nested portion, and with the other latch member preventing rebound of the first nested portion and its movable contacts linked thereto. Rotation of the actuating shaft rotates the second nested portion and loads the torsion springs against the resistance of the latched first nested portion. At a predetermined positional relationship between the first and second nested portions, a cam on the second nested portion releases the latch and the first nested portion is "snapped" to the next switch position. The inertial forces are completely absorbed by the operating mechanism and switch frame, simplifying the construction of the contacts and their supporting structure.

In addition to having the actuating shaft extend outside the casing or tank of the associated transformer, the first nested portion also includes a sleeve member which extends outside the transformer tank, with a switch position indicator being fixed to the sleeve member. Thus, the switch position indicator positively "shadows" the moving contacts, always correctly indicating the true switch position.

In a three position embodiment of the switch rotor, first, second and third stationary contacts are aligned along the bottom of an insulative mounting member, with a rotary contact having one end pivotally mounted to the intermediate stationary contact. The other end of the pivotable contact is selectively engageable with either of the remaining two stationary contacts, in addition to a no-contact position at the mid-point of the arcuate path followed by the pivotable contact. While the rotational axis of the operating mechanism is coaxial with the pivot axis of the rotatable contact, the driving force is multiplied by applying the force to a point intermediate the ends of the pivotable contact. By increasing the torque arm, the desired operating force is achieved with reduced forces between the operating mechanism and rotor. The pivotable contact moves in an arc above the three in-line stationary contacts, with ionized gas bubbles due to arcing rising away from the stationary contacts.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which.

DESCRIPTION OF THE PREFERRED EMBODIMENTS

Figure 1:
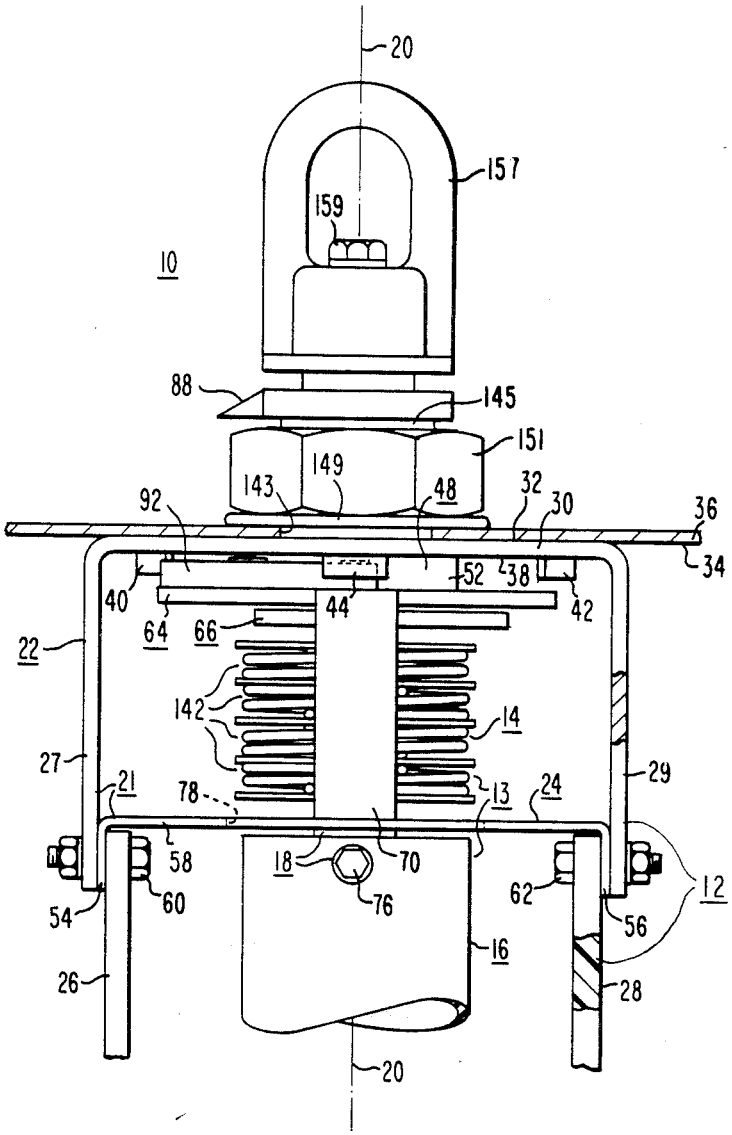
FIG. 1 is an elevational view of a switch operating mechanism constructed according to the teachings of the invention.
Figure 2:
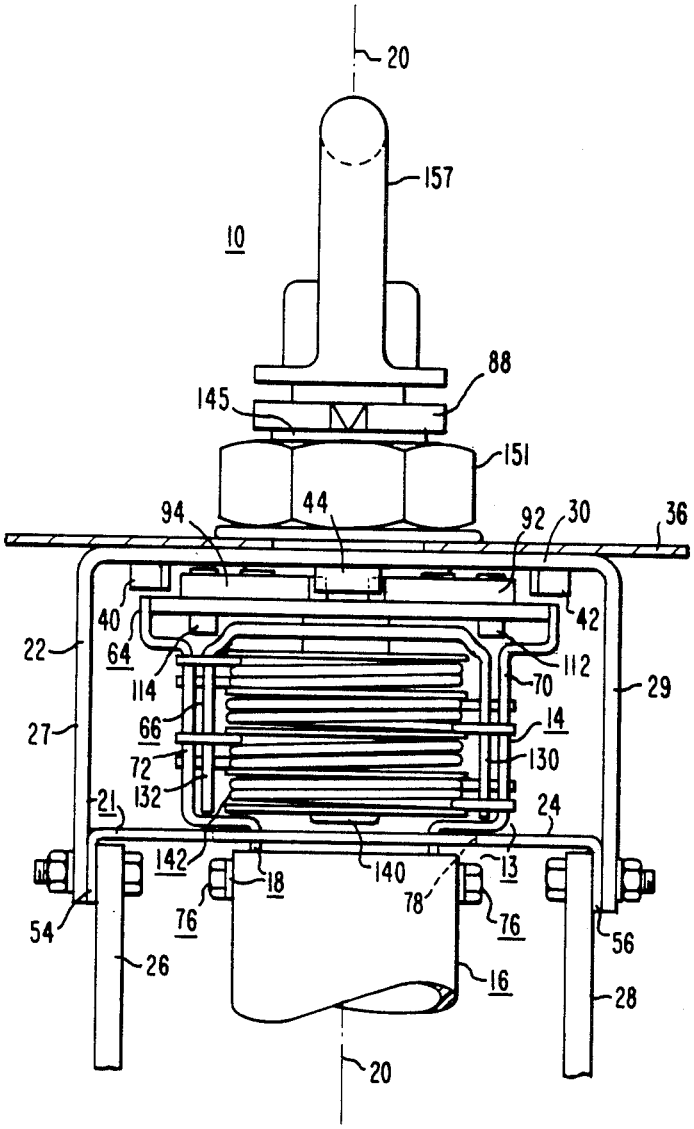
FIG. 2 is a view similar to the view of FIG. 1, except with the switch operating mechanism in a different switch position.
Figure 3:
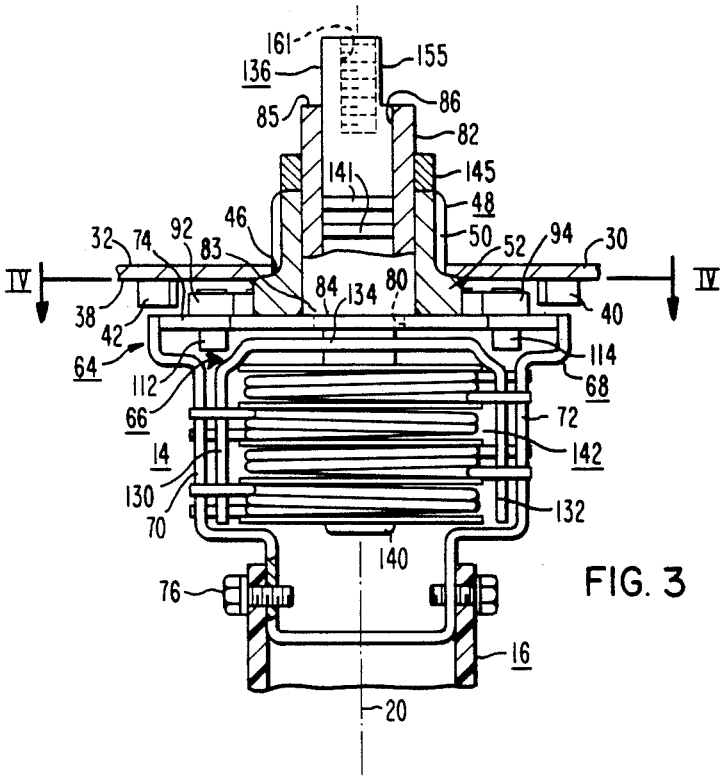
FIG. 3 is a rear view of the switch operating mechanism shown in FIG. 2, with some parts removed and some shown in section.
Figure 4:
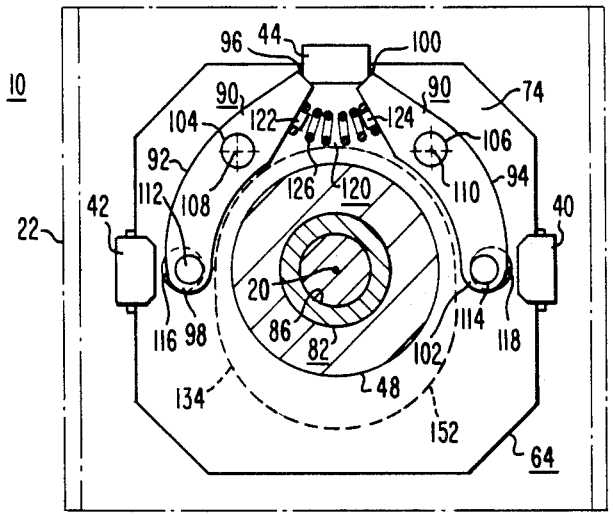
FIG. 4 is a view of the switch operating mechanism, taken between and in the direction of arrows IV—IV in FIG. 3.
Figure 5:
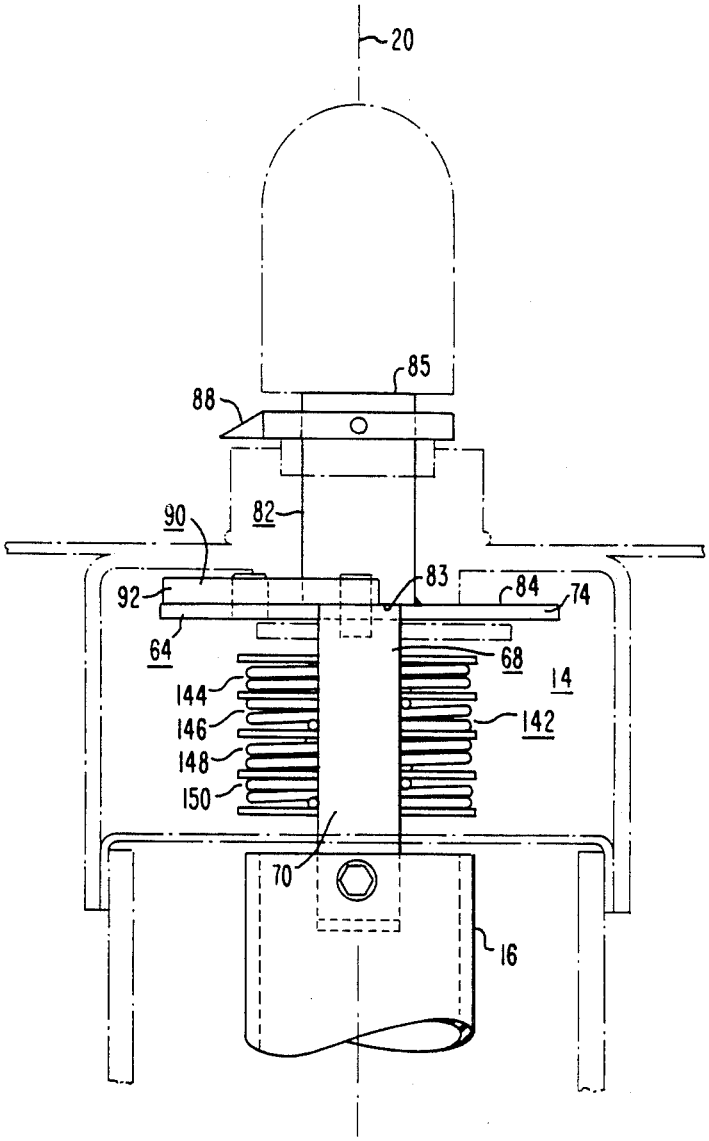
FIG. 5 is a view of the switch operating mechanism which is similar to the view shown in FIG. 1, except illustrating, in solid lines, a first rotatable portion of the switch operating mechanism.

Referring now to the drawings, FIGS. 1 through 6 illustrate a first embodiment of a new and improved rotary, snap action, load-break electrical switch 10 suitable for immersion in the liquid dielectric of a distribution transformer. Switch 10 is a multi-position switch, being applicable to both two and three position rotors, and more if the need arises. FIGS. 1 and 2 illustrate switch 10 in two different operating positions, 90° apart, and FIG. 3 is a rear view of the switch position shown in FIG. 2. FIG. 4 is a view of FIG. 3, taken between and in the direction of arrows IV—IV in FIG. 3.

Switch 10 includes a switch frame 12, and rotor means 13. Rotor means 13 includes an operating mechanism 14, a switch rotor 16, and linking means 18 for connecting the operating mechanism 14 with the switch rotor 16. In this first embodiment of the invention, the switch rotor 16 and switch frame located below the operating mechanism 14 may be the same as disclosed in my hereinbefore mentioned U.S. Pat. No. 4,412,116, and this patent is hereby incorporated into the present application by reference. Switch 10 may be a two-position switch having three like decks for a three-phase system, as illustrated in the incorporated patent. It may have more than two positions, if desired, as the new and improved operating mechanism 14 is a multi-position mechanism capable of any reasonable number of switch positions. Switch 10 may have any desired number of decks, corresponding to the number of electrical phases in the electrical system.

More specifically, switch 10 is a rotary switch having a longitudinal center line 20 which is also the rotational axis for the movable components. The switch frame 12 includes a structurally strong, box-like assembly 21 formed of first and second metallic U-shaped members 22 and 24, respectively, and insulative side members 26 and 28 which extend downwardly to the stationary contacts and their associated insulative support structures. The incorporated U.S. Pat. No. 4,412,116 may be referred to for the details of the switch frame below the box assembly 21.

U-shaped member 22 includes first and second leg portions 27 and 29, and a bight portion 30. Bight 30 includes an outer surface 32 which is mounted flush against the inner surface 34 of a wall 36 of the associated electrical apparatus, such as a distribution transformer. Bight 30 includes an inner surface 38 to which a plurality of stop members are secured, such as by welding, with there being a stop member for each position of switch 10. With the switch rotor of the incorporated patent, there would be two stops disposed 90° apart, such as stop members 40 and 42. If a three position switch is desired, for example, an additional stop 44 would be added. Since the primary switching application for loop feeds requires either a two or a three position switch, higher numbers of positions will not be described in detail, but it will be apparent how additional positions may be added by simply adding stop members.

Bight 30 includes an opening 46, best shown in FIG. 3, through which a metallic mounting boss or hub 48 is disposed. Hub 48 includes a circular, threaded portion 50 having an outside diameter sized to snugly extend through opening 46 from side 38 of bight 30, and a circular portion or flange 52 having an outside diameter larger than the diameter of opening 46. A nut 151, shown in FIGS. 1 and 2, secures hub 48 in its assembled position.

U-shaped member 24 extends across the outwardly extending ends of legs 27 and 29. For example, member 24 may have first and second leg portions 54 and 56 and a bight 58. Bight 58 may be sized to snugly extend between leg portions 26 and 28, with fastener means, such as nut and bolt combinations 60 and 62, securing the adjacent leg portions together. The insulative side members 26 and 28 which extend down to the stationary contact decks may also be secured to the metallic box assembly 21 by the same nut and bolt combinations.

Operating mechanism 14 includes first and second rotatable portions 64 and 66, respectively, which are independently rotatable about center line 20. To aid in identifying the components of the two rotatable portions 64 and 66, the first rotatable portion 64 is shown in solid outline in FIG. 5, and the second rotatable portion 66 is shown in solid outline in FIG. 6. The first rotatable portion 64 includes a substantially U-shaped metallic member 68, with the U-shaped configuration best shown in FIGS. 2 and 3. U-shaped member 68 includes first and second leg portions 70 and 72, and a bight 74. The first rotatable portion 64 is directly linked to the switch rotor 16. The linking means 18 may include extensions of leg portions 70 and 72, and screws, such as screw 76. Legs 70 and 72 extend through an opening 78 in the bight 58 of metallic U-shaped member 24.

Bight 74 has a central opening 80 therein, best shown in FIG. 3, and a tubular member or sleeve 82 has a first axial end 83 fixed to outer surface 84 of bight 74, such as by welding. An opening 86, which extends from the first axial end 83 to a second axial end 85, is sized to uniformly continue the opening 80 in bight 74. A switch operating position indicator 88 is fixed near the second axial end 85 of the tubular member 82. Since the first rotatable portion 64 is directly connected to the switch rotor 16, position indicator 88 will always correctly indicate the actual position of the switch rotor 16.

The first rotatable portion 64 also includes latch means 90 which cooperates with the stop members fixed to the switch frame to positively latch each switch position. Latch means 90 stops the first rotatable portion 64 at a switch position without rebound, and the latch means 90 also cooperates with the stop members to completely absorb the shock and mechanical forces associated with the abrupt stopping of the rotatable portion 64. Thus, the contact structures do not have to be designed to absorb any closing forces associated with the inertia of the moving parts.

As best shown in FIG. 4, latch means 90 includes first and second elongated latch members or fingers 92 and 94, with latch member 92 having first and second ends 96 and 98, respectively, and with the latch member 94 having first and second ends 100 and 102, respectively. Latch means 90 also includes means pivotally mounting each latch member 92 and 94 on the outermost surface 84 of bight 74. For example, pivot pins 104 and 106 may be used to pivotally mount latch members 92 and 94, respectively, with their pivot axes 108 and 110 being located intermediate the first and second ends of the latch members. Pin members 112 and 114 are fixed near the second ends 98 and 102 of latch members 92 and 94, respectively, with these pin members extending perpendicularly outward from the flat major surface of the latch member which faces surface 84 of bight 74. Pin members 112 and 114 extend through openings 116 and 118, respectively, formed in bight 74, where they may be contacted by a cam lobe of the second rotatable portion 66, as will be hereinafter described.

Openings 116 and 118 are larger than the diameter of pins 112 and 114, being sized and located to allow a predetermined pivotable movement for latch members 92 and 94.

Latch means 90 also includes bias means 120, best shown in FIG. 4, disposed to bias the first ends 96 and 100 apart. Bias means 120, for example, may include spring seats 122 and 124 fixed near the first ends 96 and 100 of the latch members, and a helical compression spring 126. The purpose of spring 126 is to permit the leading latch member in the direction of the rotation of the first rotatable portion 64 to be pivoted out of the way of a stop member when it contacts the stop member, and then to be immediately biased back to its prior position, in order to prevent rebound when the trailing latch member contacts the stop. The trailing latch member cannot be pivoted by the stop, as the bias means 120 has already pivoted the latch member to its limit in this direction, with the limit being defined by pin 112 or pin 114 contacting the wall of its associated opening 116 or 118. It will be noted that the leading latch member can be pivoted until its associated pin contacts the opposite wall of the associated opening. Thus, the associated opening is sized to allow pivotable movement sufficient for the leading latch member to be deflected out of the way of a stop member.

Figure 6:
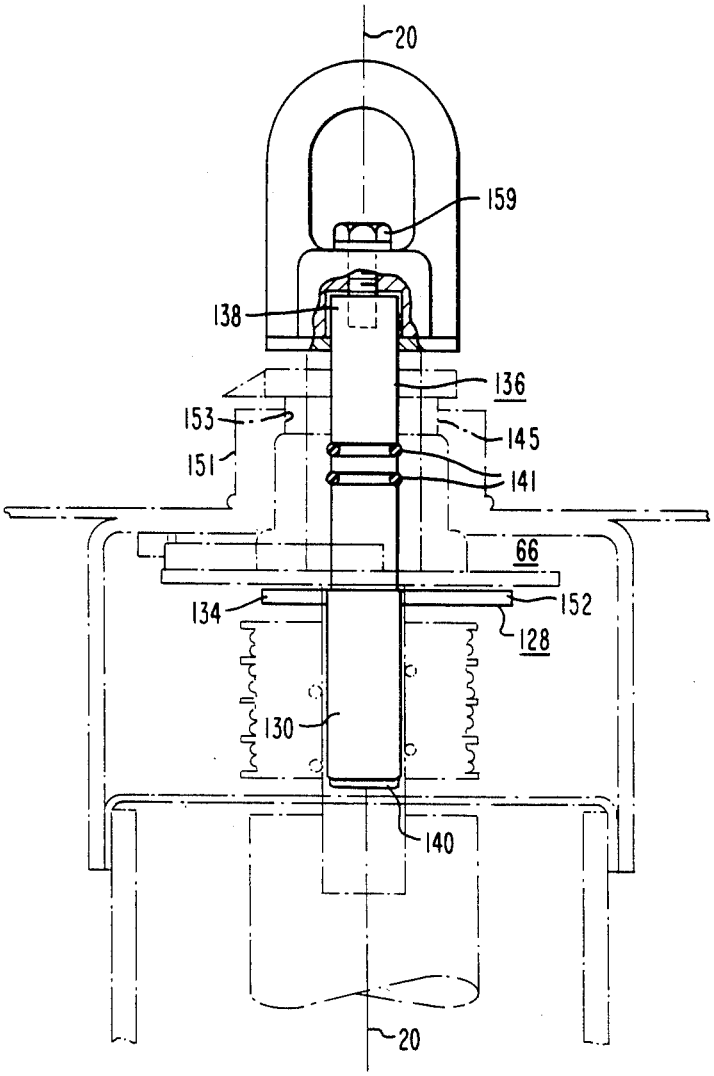
FIG. 6 is a view of the switch operating mechanism which is similar to the view shown in FIG. 1, except illustrating, in solid lines, a second rotatable portion of the switch operating mechanism.

The second rotatable portion 66 of the operating mechanism 14 is shown in solid outline in FIG. 6. The second rotatable portion 66 includes a substantially U-shaped member 128 which is nested within the substantially U-shaped member 68 of the first rotatable portion 64. Thus, the operating mechanism 14 includes first and second nested U-shaped members 68 and 128. U-shaped member 128 includes first and second leg portions 130 and 132, respectively, best shown in FIG. 3, and a connecting bight portion 134. The term "nested" as used relative to U-shaped members 68 and 128 means that their bights 74 and 134 are in closely spaced relation, having adjacent surfaces and non-adjacent surfaces, and that in their normal relative positional relationship, their first leg portions 70 and 130 are closely adjacent to one another, and their second leg portion 72 and 132 are closely adjacent to one another.

Bight 134 has a central opening through which an actuating shaft 136 is disposed and fixed, with the longitudinal axis of actuating shaft 136 coinciding with the longitudinal axis 20 of switch 10. Actuating shaft 136 extends perpendicularly outward from both major surfaces of bight 134, having a first end 138 which extends through opening 86 of tubular member 82, past end 85, and a second end 140 which is substantially the same length as the leg members 70, 72, 130 and 132. End 140 forms an arbor or support rod for bias means 142, with the bias means 142 relating the first and second rotatable portions to one another. O-rings 141 are disposed in circumferential grooves disposed in shaft 136, to provide oil seals when shaft 136 is positioned in opening 86 of tubular member 82.

When switch 10 is positioned in a tank or casing of electrical apparatus, such as a distribution transformer, threaded end 50 of mounting hub 48 is disposed through an opening 143 in the tank wall 36. A metallic sleeve bearing or ring 145 is slipped over the end 85 of tubular member 82, with the inside diameter snugly fitting the outside diameter of tubular member 82. An elastomeric gasket member 149 is also placed over mounting hub 48, against casing wall 36. A nut 151 is threadably engaged with the threads of the mounting hub 48, to compress the elastomeric washer member 149 and hold the switch 10 in the desired position. As illustrated in FIG. 6, one end of nut 151 steps inwardly to provide a bearing surface 153 which cooperates with the sleeve bearing 145 to provide an upper bearing point which aids in aligning the rotary components of switch 10. As described in the incorporated U.S. Pat. No. 4,412,116, the switch rotor 16 and the stationary contacts and their associated support provide lower bearing points which restrain the lateral movement of the rotor and axially align the rotor with the center line 20.

The upper end of actuating shaft 136 may have a flat surface 155 formed therein, as shown in FIG. 3, for receiving an operating handle 157. A screw 159 may cooperate with a threaded opening 161 disposed in the end of actuating shaft 136, to secure handle 157 in the desired position.

Bias means 142 includes a plurality of helical torsion springs, with four springs 144, 146, 148 and 150 being illustrated. The torsion springs are disposed about end 140 of actuating shaft 136, with the ends of alternate springs extending in opposite directions. As viewed in FIG. 5, the ends cross the center line 20 before being bent outwardly past leg portions 70 and 130 on one side, and leg portions 72 and 132 on the other side. The legs of each spring straddle each adjacent pair of these leg portions, such that regardless of turning direction, the torsion springs will wind up from their free positions. In other words, legs 130 and 132 of U-shaped member 128 will rotate with the rotation of the actuator shaft to contact one leg of each torsion spring, which starts to load the torsion springs as their remaining legs are held by legs 70 and 72 of the latched U-shaped member 68.

When the deflection of the torsion springs reaches a predetermined rotational angle, depending upon spring design, such as about 90°, for example, the springs will have stored therein the desired force or torque required to provide the desired quick-break, quick-make action, and the second rotary portion 66 includes latch release means for releasing the latch member from a stop which is resisting rotary movement of the first rotatable portion of the operating mechanism. The latch release means includes a cam lobe 152 which is an integral part of bight 134, with the cam lobe being configured and dimensioned to contact pin 112, or pin 114, depending upon turning direction, gradually forcing the pin outward to pivot the associated latch member about its pivot axis. When the pivoting latch member reaches a point where it slides off the associated stop member, the first rotary portion 64 of the switch 10 will be rotated by stored force in the springs to the next stop member in the direction of rotation. It will be observed that the amount of spring deflection can be equal to, or greater than, the angular rotation of the first rotary portion 64 but it cannot be less. When released from a stop, the first rotary portion 64 simply rotates to the next stop member in the travel direction. For example, the spring deflection may be 90°, and the first rotary portion of the operating mechanism may travel 90° to the next stop member, for a two-position switch, or the spring deflection may be 90° and the first rotary portion of the operating mechanism may travel 90°, for a three or four position switch.

Assuming clockwise rotation with respect to FIG. 4, when latch member 92 is released from stop member 44, the first rotary portion 64 will rotate such that the leading latch member 94 contacts stop member 40 and is pivoted against the bias of spring 126 to clear the stop member. The trailing latch member 92 will contact stop member 40, and it cannot pivot because pin 112 is already biased against a wall of opening 116. Thus, the first rotary portion 64 stops at stop member 40. In the meantime, latch member 94 has returned to its biased position, on the opposite side of stop member 40 from latch member 92, to prevent any tendency of the first rotary portion 64 to rebound when latch member 92 strikes stop member 40. Switch 10 is now positively latched in the new switch operating position. The rotary contacts have followed the first rotary portion 64, as has the switch position indicator 88.

Figure 7:
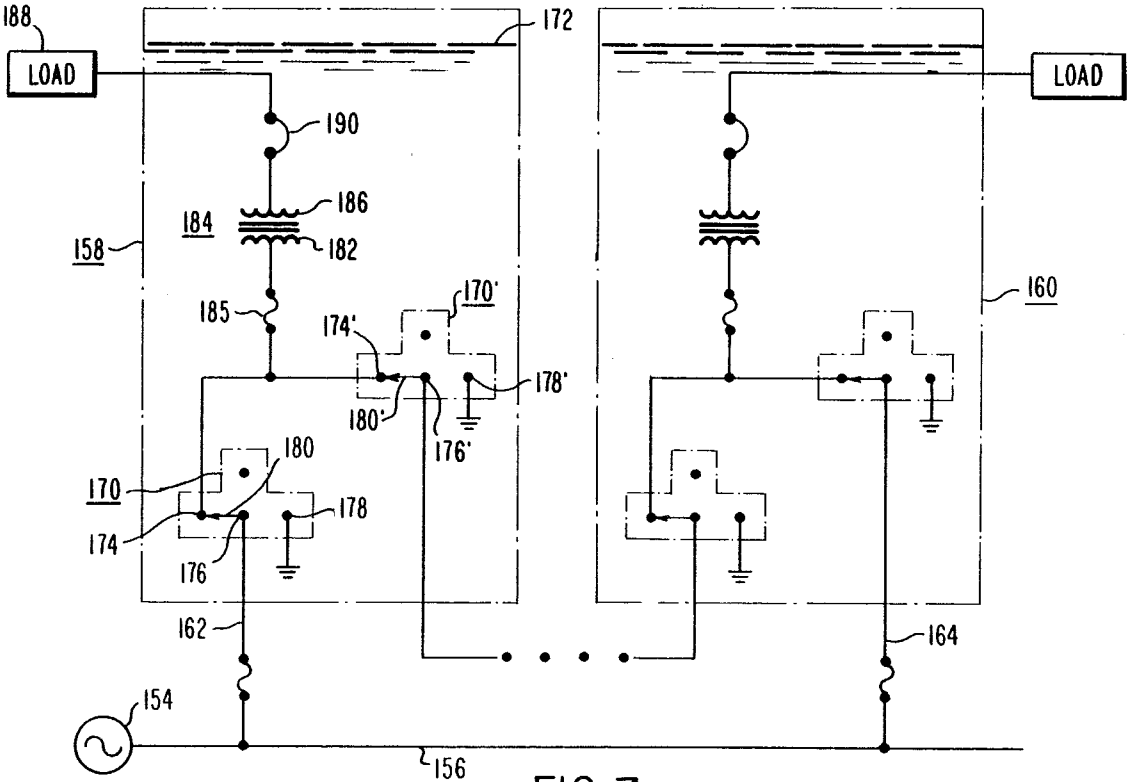
FIG. 7 is a schematic diagram illustrating the usage of three-position primary switches with electrical distribution transformers.

The new and improved operating mechanism can be used with the two position switch arrangement of my incorporated U.S. Pat. No. 4,412,116. It can also be used with equal facility for operating a three-position switch of the type often used in loop distribution systems. FIG. 7 is a schematic diagram of a typical loop distribution feed arrangement which includes a source 154 of alternating potential and a distribution line 156. A plurality of distribution transformers, indicated generally by transformers formers 158 and 160, are connected to line 156 through either of fused lines 162 or 164 via a pair of three-position switches disposed in the tank of each distribution transformer. The switches, such as switches 170 and 170' of distribution transformer 158, are disposed below the level 172 of the liquid dielectric, such as mineral oil, disposed in the transformer.

Each three position switch, such as switch 170, is arranged according to an embodiment of the invention wherein first, second and third in-line stationary terminals 174, 176 and 178 are disposed across the bottom of the switch in the mounted orientation of the switch. Line 162 and a rotary contact 180 are connected to the intermediate stationary terminal 176. Stationary terminal 174 is connected to a primary winding 182 of a core-coil assembly 184, such as via a fusible link 185, and a secondary winding 186 of the core-coil assembly is connected to a load 188, such as via a secondary circuit breaker 190. The first stationary terminal 174' of switch 170' is also connected to primary winding 182, and the intermediate stationary contact 176' is connected to the intermediate terminal of a switch associated with the next distribution transformer in the loop. Stationary terminals 178 and 178' are connected to ground. Thus, each transformer of the loop can be connected to source 154 via either or both lines 162 and 164, and workmen can isolate selected transformers and connect selected cables to ground when desired, while performing maintenance tasks.

Figure 8:
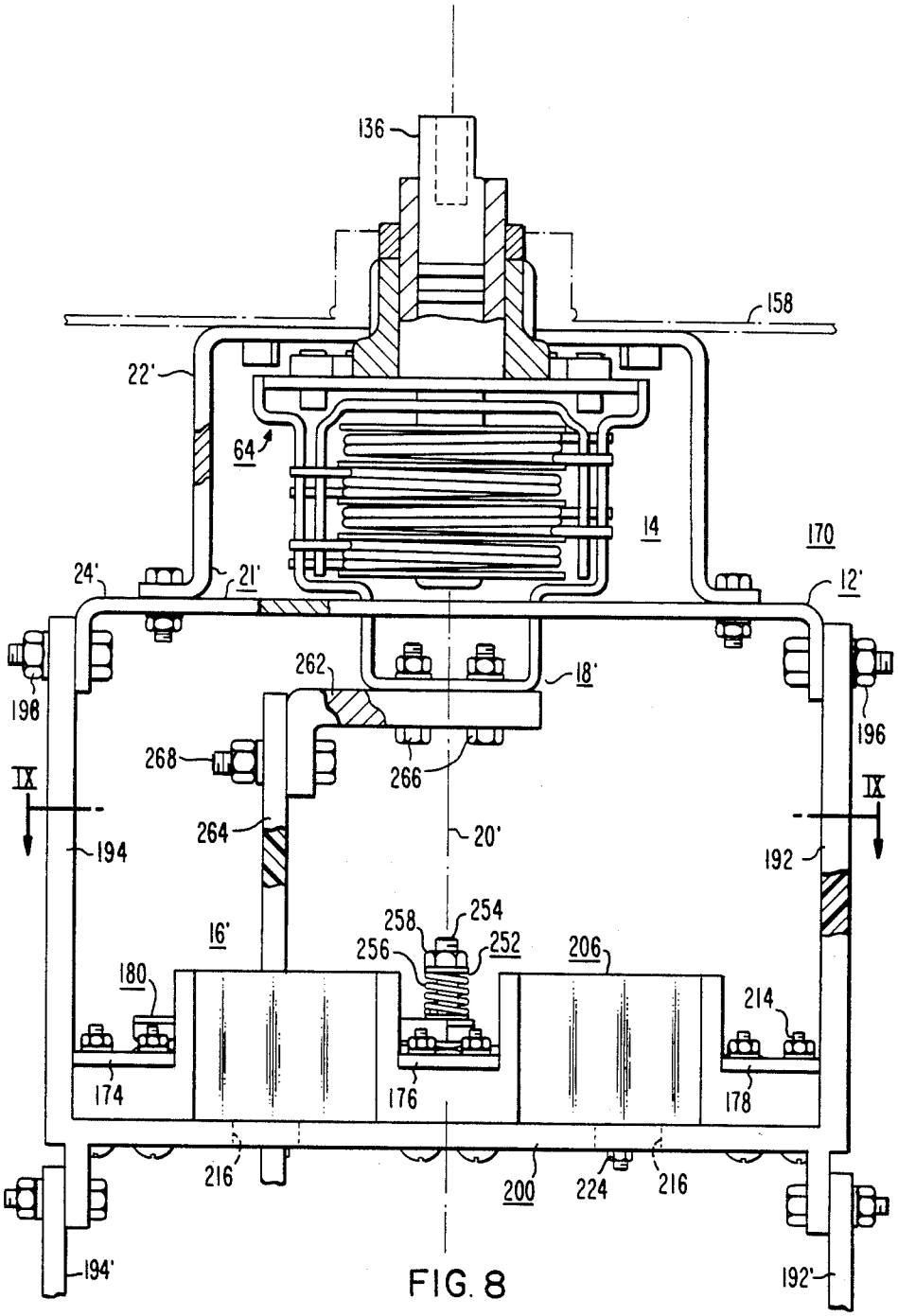
FIG. 8 is a plan view of a three-position rotary switch constructed according to the teachings of the invention.
Figure 9:
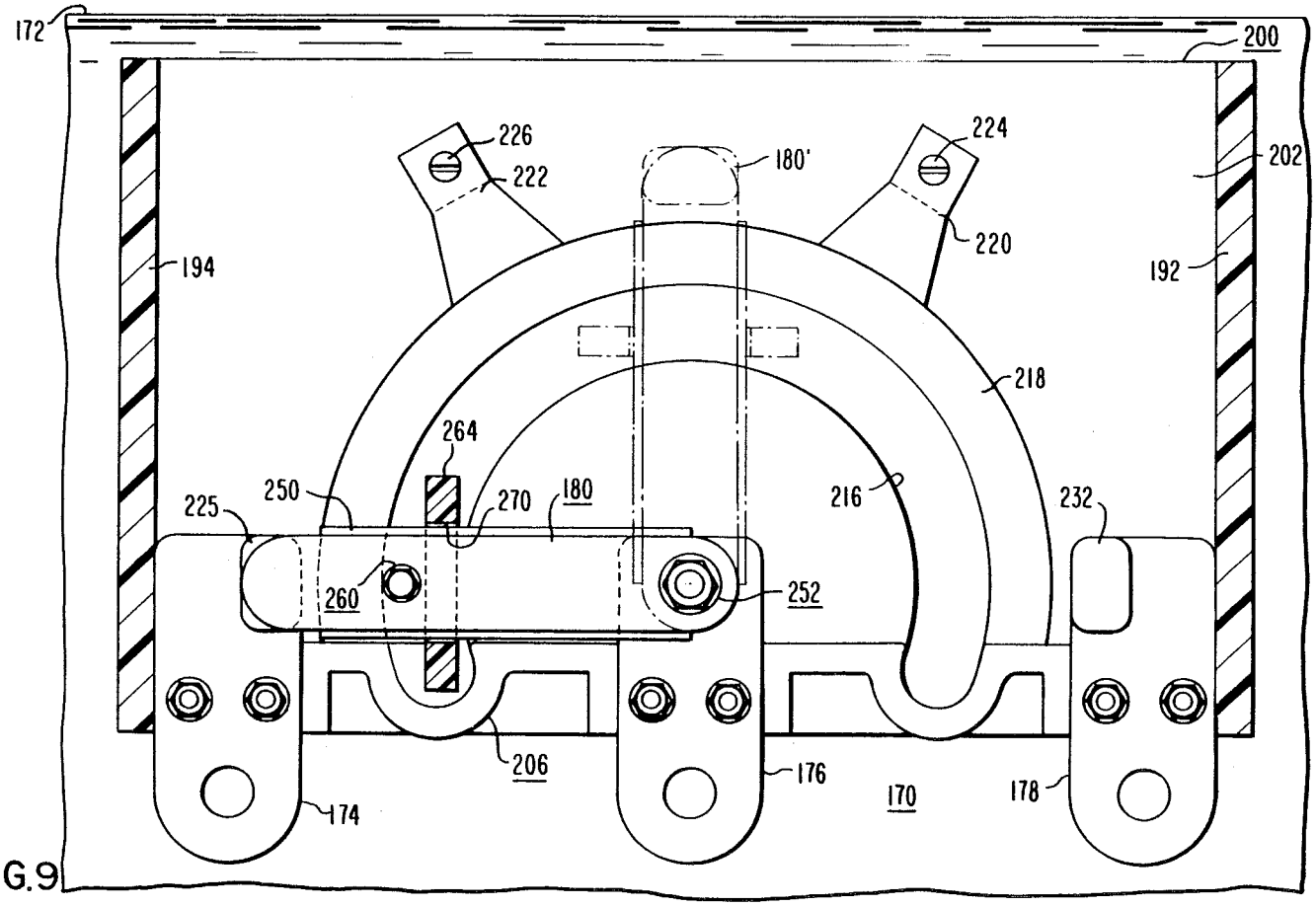
FIG. 9 is an elevational view of the switch shown in FIG. 8, taken between and in the direction of arrows IX—IX in FIG. 8.
Figure 10:
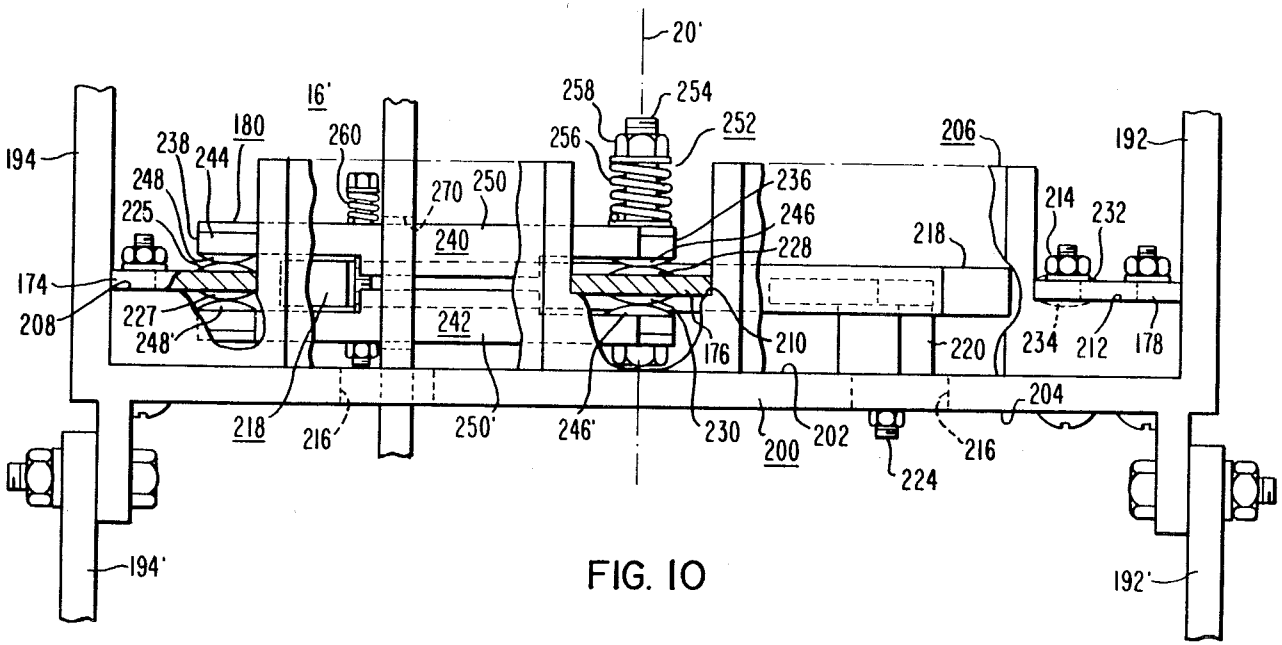
FIG. 10 is an enlarged view of the switch deck shown in FIG. 8.

FIGS. 8 and 9 are plan and elevational views of a new and improved three-position switch 170 constructed according to the teachings of the invention, with FIG. 9 being a sectional view of one phase or deck of switch 170 taken between and in the direction of arrows IX—IX in FIG. 8. FIG. 10 is an enlarged view of the switch deck shown in FIG. 8. Switch 170 includes a switch frame 12', an operating mechanism 14, which may be the same mechanism described relative to FIGS. 1 through 6, a switch rotor 16' and linking means 18' for linking the operating mechanism 14 and the switch rotor 16'. Switch frame 12' includes first and second substantially U-shaped metallic members 22' and 24' interconnected to provide a structurally strong box assembly 21', with the first deck or phase of the switch 170 being connected to the legs of U-shaped metallic member 24'. Each deck or phase of switch 170 is of like construction, and thus only one phase is illustrated. The illustrated deck includes insulative side plates 192 and 194. Similar side plates of the next deck are referred to with references 192' and 194'. Side plates 192 and 194 are connected to metallic U-shaped member 24', such as via nut and bolt combinations 196 and 198. An insulative mounting member 200 extends between side plates 192 and 194, with member 200 having first and second major, flat, opposed surfaces 202 and 204, respectively. Rising from surface 202, at the lower edge in the FIG. 9 orientation of switch 170, is an insulative barrier member 206 having indented flat portions 208, 210 and 212 for receiving stationary terminals 174, 176 and 178, respectively. Barrier 206 has openings which extends through the flat mounting portions 208, 210 and 212 for receiving nut and bolt combinations, such as combination 214, with the same nut and bolt combination securing the insulating barrier member 206 to the mounting member 200.

An arcuate semi-circular opening 216 is disposed through mounting member 200, with opening 216 extending between major flat surfaces 202 and 204, and with the ends of the semi-circular opening 216 terminating at the barrier member 206. Insulative barrier member 206 includes a curved guide portion 218, the inner surface of which is flush with the outer wall of opening 216. The ends of curved guide portion 218 extend integrally upward from the barrier member 206, in the orientation shown in FIG. 9, with the outer portions of the curved guide loop being supported from surface 202 of mounting member 200 via mounting legs 220 and 222. Nut and bolt combinations 224 and 226 secure the mounting legs to mounting member 200.

Stationary terminals 174, 176 and 178 each have raised contacts on opposite major surfaces, such as contacts 225 and 227 on stationary terminal 174, contacts 228 and 230 on stationary terminal 176, and contacts 232 and 234 on stationary terminal 178. These contacts are formed of a good arc resistive metal, such as copper-tungsten, which resists sputtering and welding when subjected to an electrical arc.

The rotary contact 180 is an elongated structure having first and second ends 236 and 238, respectively, with contact 180 having first and second spaced portions 240 and 242 of like construction. The first portion 240 includes a conductive member 244, formed of a metal such as copper, having raised electrical contacts 246 and 248 adjacent to the first and second ends 236 and 238, respectively, with the contacts being connected to a selected major surface of the conductive member 244. An iron core element, such as a steel channel member 250, surrounds the remaining three sides or surfaces of conductive member 244. The second portion 242 is given the same reference numerals as the first portion 240, except for a prime mark.

Bias means 252 aids in forming a rotary electrically conductive joint at the first end of rotary contact 180, with the bias means 252 linking openings disposed through the rotary contact 180, which openings are oriented to pass through the centers of contacts 246, 228, 230 and 246'. Bias means 252 includes a bolt 254 which extends through the aligned openings, a spring 256 and a nut 258. While the spring 256 presses the contacts 246, 228, 230 and 246' tightly together, it will be noted that the spring 256 is outside the current flow path, unlike rotary contact joints which use garter type springs. Also, the pivot axis formed by bolt 254 is coaxial with the rotational axis of operating mechanism 14, with both being in common with the center line 20' of switch 170.

The first and second sections 240 and 242 of rotary contact 180 are also biased together via a second bias means 260, which may be similar to bias means 252, except disposed adjacent to the curved contact guide 218. Bias means 260 biases the first and second portions of the rotary contact 180 against guide 218 when the rotary contact 180 is not engaging the contacts of stationary terminals 174 or 178. Bias means 260 biases contacts 248 and 248' of the first and second portions, respectively, of the rotary contact against the contacts of the stationary terminals, when the rotary contact 180 is in the associated switch position. Thus, the contact guide means always correctly aligns the rotary contact 180 with the stationary contacts, simplifying the manufacture and assembly of the remaining portion of the switch 170.

The steel channel members 250 and 250' have the ends of their leg portions of the channels closely spaced from one another, without actual contact, to form electromagnets which increase contact pressure during short circuit current surges through the rotary contact 180.

The linking means 18' which connects the operating mechanism 14 with the switch rotor 16' includes a crank arm 262 and a driver member or arm 264, which combination offsets the driving force from the center line 20' and increases the torque applied to the rotary contact 180. This enables the desired operating force to be achieved without destructive forces at the interface between the operating mechanism 14 and rotor 16'. Crank arm 262 may be a metallic member having a leg portion connected to the first rotatable portion 64 of the operating mechanism 14 by nut and bolt combinations 266, and a leg portion connected to driver arm 264 via nut and bolt combinations 268.

Driver member 264 is an insulative member having an opening 270 for snugly receiving rotatable contact 180, and like additional openings for the rotary contacts of each additional electrical phase, if any. Driver member 264 extends through arcuate opening 216 of the mounting board 200, to engage the rotary contacts of the additional electrical phases.

As illustrated in FIGS. 8 and 9, rotary contact 180 is engaged with stationary terminal 174, which is connected to the primary winding 182 of transformer 158 in FIG. 7. If the actuating shaft 136 is turned 90° to operate the three-position switch 170 to the next position, and rotary contact will advance 90° to the broken outlined position 180' shown in FIG. 9, with this position of switch 170 disconnecting terminal 176 from terminal 174, to provide an open circuit position. If the actuating shaft 136 is again turned 90° in the same circumferential direction, the switch will be operated to the next switch position which connects rotary contact 180 to terminal 174, which is the grounded position in the FIG. 7 embodiment. It will be noted that any ionized gas bubbles produced in the liquid dielectric 172 due to arcing will not envelope any adjacent terminals, as the gas bubbles will rise upwardly, with reference to the FIG. 9 orientation of switch 170, away from the in-line stationary terminals 174, 176 and 178.

In summary, there has been disclosed a new and improved rotary quick-break, quick-make switch suitable for immersion in the liquid dielectric of a distribution transformer. The switch possesses the speed and torque necessary to pass the load interruption test, the momentary current test, and the fault close-in test, conventionally applied to these primary switches. A new and improved operating mechanism may be used with a two-position switch, a three-position switch, or switches with even greater numbers of positions, simply by changing the number and position of stop members attached to the switch frame. Each position of the switch is latched-in the operating mechanism, and all closing and opening forces are borne by the operating mechanism, greatly simplifying the contact structure and support. The switch position indicator is tied directly to the rotary contacts of the switch, always correctly indicating the actual switch position, regardless of the position of the operating shaft. While the switch operating mechanism and pivot axis of the rotary contact in a three-position embodiment of the invention are coaxial, the driving arm is moved outwardly from this axis to increase the torque applied to the rotary contact.

I claim as my invention:

1. A rotary, snap-action electrical switch suitable for immersion in the liquid dielectric of an electrical transformer and operatable externally thereto, comprising:

a switch frame, and rotor means, said switch frame including stop members, one for each position of the switch, and stationary electrical contacts, said rotor means being mounted for rotation on a longitudinal center line within said switch frame, said rotor means including a switch rotor and an operating mechanism, said switch rotor including electrical contacts engageable with said stationary electrical contacts at predetermined switch positions, said operating mechanism including first and second nested portions each independently rotatable about said center line, spring means which translates rotation of the second nested portion to a bias on the first nested portion, and means linking the first nested portion with said switch rotor, said first nested portion including latch means for latching the first nested portion at a stop member, said latch means comprising first and second latch members, with one latch member stopping the first nested portion at a stop member, and the other preventing rebound, said second nested portion including an actuation shaft for loading the spring means against the resistance of the latched first nested portion, said second nested portion further including latch release means which releases the latch means from a stop member during the loading of the spring means, with the loaded spring means causing the unlatched first nested portion to advance to an adjacent stop member with a snap action, while simultaneously advancing the switch rotor to an adjacent switch position.

2. The switch of claim 1 wherein the first and second nested portions of the operating mechanism each include elongated sections adapted to extend outside the casing of an associated electrical transformer, and including switch position indicator means fixed to the elongated section of the first nested portion, to cause the indicator means to move with the electrical contacts of the switch rotor.

3. The switch of claim 1 wherein the first and second latch members each have first and second ends, including means pivotally mounting the first and second latch members to the first nested portion, said first ends of the first and second latch members being positioned on opposite sides of a stop member when the first nested portion is stationary, and means for biasing said first ends apart, whereby the leading latch member in the direction of rotation of the first nested portion is moved by a stop member against the bias to cause it to pass the stop member and spring back to prevent rebound when the traveling latch member engages the stop member to stop the rotation of the first nested portion.

4. The switch of claim 1 wherein the first and second nested portions include first and second substantially U-shaped members, respectively, each having a bight and first and second legs, with the second U-shaped member being nested within the first U-shaped member, and wherein the spring means includes torsion springs having spring ends engageable by the legs of the first and second U-shaped members.

5. The switch of claim 4 including means pivotally mounting the first and second latch members on the bight of the first U-shaped member, said first and second latch members each having first and second ends, with their first ends being positioned on opposite sides of a stop member when the first nested portion is stationary, and including means for biasing the first ends of the first and second latch members apart, such that the leading latch member in the direction of rotation of the first nested portion is moved by a stop member against the bias to cause it to pass the stop member and spring back to prevent rebound when the trailing latch member engages the stop member to stop the rotation of the first nested portion.

6. The switch of claim 5 wherein the nested first and second U-shaped members have like orientations, with their bights having adjacent sides and non-adjacent sides, with the first and second latch members being pivotally mounted on the non-adjacent side of the bight of the first U-shaped member, and including first and second pin members extending perpendicularly outward from the second ends of the first and second latch members, respectively, through first and second openings, respectively, in the bight of the first U-shaped member, with said first and second openings being sized to enable predetermined pivotable movement of the first and second latch members, and wherein the latch release means includes a cam carried by the second U-shaped member which contacts a pin member to release the associated latch member from a stop member at a predetermined positional relationship between the first and second U-shaped members.

7. The switch of claim 1 including contact guide means on the switch frame, said contact guide means and electrical contacts on the switch rotor and switch frame cooperatively preventing axial movement of the rotor means, while guiding the electrical contacts of the switch rotor and switch frame into exact alignment.

8. The switch of claim 1 wherein the switch rotor includes a tubular insulative member oriented coaxial with the longitudinal center line, and the means which links the first nested portion and switch rotor includes means which extends from the first nested portion into the I.D. of the tubular insulative member.

9. The switch of claim 1 wherein the switch rotor includes an elongated electrical contact having first and second ends, means pivotally mounting the first end on the switch frame, in continuous electrical contact with a stationary electrical contact, with the pivot axis being coaxial with the longitudinal center line, and wherein the means linking the operating mechanism with the switch rotor includes a driver arm which drives the pivotable elongated electrical contact at a driving point intermediate its ends, offset from the pivot axis.

10. The switch of claim 9 wherein the elongated electrical contact of the switch rotor includes first and second spaced conductive portions each having first and second ends corresponding to the first and second ends of the elongated electrical contact, first bias means biasing the first ends of the first and second spaced conductive portions against a stationary electrical contact on the switch frame to enable current to pass between the first and second conductive portions and the stationary electrical contact without passing through the first bias means.

11. The switch of claim 10 including contact guide means on the switch frame, and second bias means for biasing the first and second spaced conductive portions against the contact guide means when the second ends of the first and second spaced conductive portions are not engaged with stationary contacts on the switch frame, and biasing the second ends of the first and second conductive portions against a stationary electrical contact during such engagement.

12. The switch of claim 9 wherein the switch frame includes a flat insulative mounting member having insulative means which supports the stationary electrical contacts, said flat mounting member defining an arcuate opening for enabling the driver arm to extend to similar mounting members associated with other electrical phases.

13. The switch of claim 9 wherein the switch frame includes a flat insulative mounting member disposed in a vertical orientation in the operative orientation of the switch, insulative means on said flat insulative mounting member adjacent to its lower end for supporting the stationary electrical contacts, and with the elongated electrical contact being pivotable in an arc above said stationary contacts, such that a gas bubble associated with arcing in a liquid dielectric will rise away from the stationary electrical contacts.

14. The switch of claim 13 wherein the stationary electrical contacts include first, second and third electrical contacts spaced along the lower edge of the flat insulative mounting member, with the second electrical contact means being intermediate the first and third electrical contacts, and wherein the first end of the pivotable electrical contact is in continuous electrical contact with said second stationary electrical contact, and with the second end of the electrical contact means being selectively engageable with the first and third stationary contacts.

15. The switch of claim 10 including iron core elements disposed about the first and second spaced conductive portions of the rotary electrical contact, to increase contact force in response to excessive current flow through the rotary electrical contact.

16. A rotary, snap-action electrical switch suitable for immersion in the liquid dielectric of an electrical transformer and operable externally thereto, comprising:

a switch frame, and rotor means mounted for rotation within said switch frame, on a predetermined longitudinal center line, said switch frame including first, second and third in-line stationary electrical contacts, with said second stationary electrical contact being positioned midway between said first and second stationary electrical contacts, said rotor means including:

(a) a rotary, snap-action operating mechanism having at least three operating positions, with the rotational axis being coaxial with the longitudinal center line, (b) an elongated pivotable electrical contact having first and second ends, (c) means pivotably mounting the first end of the pivotable electrical contact to the second stationary electrical contact, on a pivot axis coaxial with the longitudinal center line, such that the second end is selectively engageable with the first and third stationary electrical contacts, and (d) driver means linking the rotary operating mechanism and pivotable electrical contact, with the driving point being intermediate the first and second ends of the pivotable electrical contact, offset from the longitudinal center line.

17. The switch of claim 16 wherein the pivotable electrical contact includes first and second spaced conductive portions, each having first and second ends corresponding to the first and second ends of the pivotable electrical contact, first bias means biasing the first ends of the first and second spaced conductive portions against the second stationary electrical contact on the switch frame, to enable current to pass between the first and second conductive portions and the second stationary electrical contact without passing through the first bias means.

18. The switch of claim 17 including contact guide means on the switch frame, and second bias means biasing the first and second spaced conductive portions against the contact guide means when the second ends of the first and second spaced conductive portions are not engaged with stationary contacts on the switch frame, and biasing the second ends of the first and second conductive portions against a stationary electrical contact during such engagement.

19. The switch of claim 16 wherein the switch frame includes a flat insulative mounting member having insulative means which supports the first, second and third stationary electrical contacts, said mounting member defining an arcuate opening for enabling the driver means to extend to similar mounting members associated with any additional electrical phases.

20. The switch of claim 16 wherein the switch frame includes a flat insulative mounting member disposed in a vertical orientation in the operative orientation of the switch, insulative means on said flat insulative mounting member, adjacent to its lower edge, for supporting the stationary electrical contacts, and with the elongated electrical contact being pivotable in an arc above said stationary contacts, such that a gas bubble associated with an arc in the liquid dielectric will rise away from the stationary electrical contacts.

21. The switch of claim 17 including iron core elements disposed about the first and second spaced conductive portions of the rotary electrical contact means to increase contact force in response to excessive current flow through the pivotable electrical contact means.

* * * * *